US007661205B2

(12) United States Patent
Johnson

(10) Patent No.: US 7,661,205 B2
(45) Date of Patent: Feb. 16, 2010

(54) AUTOMATED TIGHTENING SHOE

(76) Inventor: Gregory G. Johnson, 7310 132nd St. North, Hugo, MN (US) 55036

( * ) Notice: Subject to any disclaimer, the term of this patent is extended or adjusted under 35 U.S.C. 154(b) by 363 days.

(21) Appl. No.: 11/818,370

(22) Filed: Jun. 14, 2007

(65) Prior Publication Data

US 2007/0240334 A1 Oct. 18, 2007

Related U.S. Application Data

(60) Continuation-in-part of application No. 11/269,941, filed on Nov. 8, 2005, now Pat. No. 7,331,126, which is a continuation of application No. 10/732,664, filed on Dec. 9, 2003, now Pat. No. 7,096,559, which is a continuation-in-part of application No. 10/093,918, filed on Mar. 7, 2002, now Pat. No. 6,896,128, which is a division of application No. 09/675,607, filed on Sep. 29, 2000, now Pat. No. 6,467,194, which is a continuation-in-part of application No. 09/048,772, filed on Mar. 26, 1998, now abandoned.

(51) Int. Cl.
*A43C 11/00* (2006.01)

(52) U.S. Cl. ..... 36/50.1

(58) Field of Classification Search ..... 36/50.1, 36/50.5, 138, 58.6, 58.5
See application file for complete search history.

(56) References Cited

U.S. PATENT DOCUMENTS

| | | | | |
|---|---|---|---|---|
| 737,769 | A | | 9/1903 | Preston |
| 2,124,310 | A | | 7/1938 | Murr, Jr. |
| 3,703,775 | A | | 11/1972 | Gatti |
| 3,793,749 | A | | 2/1974 | Gertsch et al. |
| 4,426,796 | A | | 1/1984 | Spademan |
| 4,619,058 | A | | 10/1986 | Gumbert |
| 4,653,204 | A | | 3/1987 | Morell et al. |
| 4,654,985 | A | * | 4/1987 | Chalmers ..... 36/118.2 |
| 4,748,726 | A | | 6/1988 | Schoch |
| 4,787,124 | A | | 11/1988 | Pozzobon et al. |
| 4,811,503 | A | * | 3/1989 | Iwama ..... 36/118.1 |
| 4,937,952 | A | | 7/1990 | Olivieri |
| 4,937,953 | A | | 7/1990 | Walkhoff |
| 4,942,680 | A | | 7/1990 | Benetti |
| 5,152,038 | A | | 10/1992 | Schoch |
| 5,157,813 | A | | 10/1992 | Carroll |
| 5,158,559 | A | | 10/1992 | Pozzobon et al. |
| 5,167,083 | A | | 12/1992 | Walkhoff |
| 5,175,949 | A | | 1/1993 | Seidel |
| 5,205,055 | A | | 4/1993 | Harrell |
| 5,230,171 | A | | 7/1993 | Cardaropoli |
| 5,291,671 | A | | 3/1994 | Caberlotto et al. |
| 5,325,613 | A | | 7/1994 | Sussmann |

(Continued)

FOREIGN PATENT DOCUMENTS

| | | |
|---|---|---|
| FR | 2399811 | 3/1979 |

(Continued)

*Primary Examiner*—Ted Kavanaugh
(74) *Attorney, Agent, or Firm*—Moss & Barnett

(57) ABSTRACT

An automated tightening shoe with crisscrossed laces and a tightening mechanism which operates in one direction to cause automatic tightening of the crisscrossed laces to tighten the shoe about a wearer's foot, and which can be released easily so that the shoe can be removed from the wearer's foot.

15 Claims, 12 Drawing Sheets

U.S. PATENT DOCUMENTS

| | | | | |
|---|---|---|---|---|
| 5,327,662 | A | 7/1994 | Hallenbeck | |
| 5,335,401 | A | 8/1994 | Hanson | |
| 5,341,583 | A | 8/1994 | Hallenbeck | |
| 5,379,532 | A | 1/1995 | Seidel | |
| 5,461,801 | A | 10/1995 | Anderton | |
| 5,606,778 | A | 3/1997 | Jungkind | |
| 5,791,068 | A * | 8/1998 | Bernier et al. | 36/50.1 |
| 5,839,210 | A | 11/1998 | Bernier et al. | |
| 5,983,530 | A | 11/1999 | Chou | |
| 6,032,387 | A | 3/2000 | Johnson | |
| 6,286,233 | B1 | 9/2001 | Gaither | |
| 6,289,558 | B1 | 9/2001 | Hammerslag | |
| 6,324,774 | B1 | 12/2001 | Zebe, Jr. | |
| 6,378,230 | B1 | 4/2002 | Rotem et al. | |
| 6,427,361 | B1 | 8/2002 | Chou | |
| 6,467,194 | B1 * | 10/2002 | Johnson | 36/50.1 |
| 6,560,898 | B2 | 5/2003 | Borsoi et al. | |
| 6,643,954 | B2 | 11/2003 | Voswinkel | |
| 6,671,980 | B1 | 1/2004 | Liu | |
| 6,807,754 | B2 | 10/2004 | Miller et al. | |
| 6,883,255 | B2 | 4/2005 | Morrow et al. | |
| 6,896,128 | B1 * | 5/2005 | Johnson | 36/50.1 |
| 6,926,289 | B2 | 8/2005 | Wang | |
| 7,065,906 | B2 | 6/2006 | Jones et al. | |
| 7,076,843 | B2 | 7/2006 | Sakabayashi | |
| 7,096,559 | B2 * | 8/2006 | Johnson | 29/433 |
| 7,103,994 | B2 * | 9/2006 | Johnson | 36/50.1 |
| 7,159,340 | B2 | 1/2007 | Borsoi | |
| 7,195,251 | B2 | 3/2007 | Walker | |
| 7,331,126 | B2 * | 2/2008 | Johnson | 36/50.1 |
| 2002/0095750 | A1 * | 7/2002 | Hammerslag | 24/68 SK |
| 2003/0066207 | A1 | 4/2003 | Gaither | |
| 2003/0177661 | A1 | 9/2003 | Tsai | |
| 2004/0181972 | A1 | 9/2004 | Csorba | |
| 2004/0226190 | A1 | 11/2004 | Elkington et al. | |
| 2005/0039348 | A1 * | 2/2005 | Raluy et al. | 36/50.1 |
| 2005/0126043 | A1 | 6/2005 | Reagan et al. | |
| 2005/0198866 | A1 * | 9/2005 | Wiper et al. | 36/50.1 |
| 2006/0117607 | A1 | 6/2006 | Pare et al. | |
| 2006/0191164 | A1 | 8/2006 | Dinndorf et al. | |
| 2006/0201031 | A1 | 9/2006 | Jones et al. | |
| 2007/0011914 | A1 | 1/2007 | Keen et al. | |
| 2007/0068041 | A1 | 3/2007 | Farys | |

FOREIGN PATENT DOCUMENTS

| | | |
|---|---|---|
| WO | WO 2004/034831 | 4/2004 |

* cited by examiner

AUTOMATED TIGHTENING SHOE

CROSS-REFERENCE TO RELATED APPLICATION

This application is a continuation-in-part of U.S. Ser. No. 11/269,941 filed on Nov. 8, 2005, now U.S. Pat. No. 7,331,126 which is a continuation of U.S. Ser. No. 10/732,664 filed on Dec. 9, 2003, now U.S. Pat. No. 7,096,559, which is a continuation-in-part of U.S. Ser. No. 10/093,918 filed on Mar. 7, 2002, now U.S. Pat. No. 6,896,128, which is a divisional of U.S. Ser. No. 09/675,607 filed on Sep. 29, 2000, now U.S. Pat. No. 6,467,194, which is a continuation-in-part of U.S. Ser. No. 09/048,772 filed on Mar. 26, 1998, now abandoned, all of which are hereby incorporated in their entirety.

FIELD OF THE INVENTION

The present invention pertains to a shoe and, more particularly, to an automated tightening shoe. The shoe is provided with an automated tightening system including a tightening mechanism which operates in one direction to cause automatic tightening of the shoe about a wearer's foot, and which can be released easily so that the shoe can be readily removed from the wearer's foot. The invention is chiefly concerned with an automated tightening shoe of the sport or athletic shoe variety, but the principles of the invention are applicable to shoes of many other types and styles.

BACKGROUND OF THE INVENTION

Footwear, including shoes and boots, are an important article of apparel. They protect the foot and provide necessary support, while the wearer stands, walks, or runs. They also can provide an aesthetic component to the wearer's personality.

A shoe or boot comprises a sole constituting an outsole and heel, which contact the ground. Attached to the shoe that does not constitute a sandal or flip flop is an upper that acts to surround the foot, often in conjunction with a tongue. Finally, a closure mechanism draws the medial and lateral portions of the upper snugly around the tongue and wearer's foot to secure the shoe to the foot.

The most common form of a closure mechanism is a lace criss-crossing between the medial and lateral portions of the upper that is pulled tight around the instep of the foot, and tied in a knot by the wearer. While simple and practical in functionality, such shoe laces need to be tied and retied through the day as the knot naturally loosens around the wearer's foot. This can be a hassle for the ordinary wearer. Moreover, young children may not know how to tie a knot in the shoe lace, thereby requiring assistance from an attentive parent or caregiver. Furthermore, elderly people suffering from arthritis may find it painful or unduly challenging to pull shoe laces tight and tie knots in order to secure shoes to their feet.

The footwear industry has therefore produced shoes for children and adults containing Velcro straps in lieu of shoelaces. Such straps extending from the medial upper are readily fastened to a complementary Velcro patch secured to the lateral upper. But, such Velcro closures can frequently become disconnected when too much stress is applied by the foot. This particularly occurs for athletic shoes and hiking boots. Moreover, Velcro closures can become worn relatively quickly, losing their capacity to close securely. Furthermore, many wearers find Velcro straps to be aesthetically ugly on footwear.

Efforts have been made therefore within the footwear industry to provide alternative designs that overcome problems associated with loosened shoe laces. U.S. Pat. No. 7,159,340 issued to Borsoi discloses a series of strategically located keepers along the medial and lateral uppers for interacting with the tied shoe lace to force the foot towards the heel of the boot or shoe. U.S. Pat. No. 6,671,980 issued to Liu teaches an anchor assembly secured to the shoe upper and shoe laces that increases the tension of the tied shoe laces, but may be easily pivoted to a released position when the wearer wants to remove the shoe. A shoe lace is still required for this anchor assembly.

Other shoe designs dispense with shoe laces entirely. U.S. Pat. No. 6,883,255 issued to Morrow et al., for example, illustrates the type of buckles that are popular on ski or snowboard boots. U.S. Pat. No. 7,065,906 issued to Jones et al. discloses a shoe featuring a special closure panel that is drawn around the medial and lateral uppers and wearer's instep by cables concealed within the shoe upper or sole. The cables are tightened by a pivoting lever mechanism concealed within the heel of the shoe that may be adjusted by means of a screw or other mechanism. Meanwhile, U.S. Pat. No. 6,643,954 issued to Voswinkel discloses a tensioning lever contained within the interior of the shoe that is engaged by the foot to interact via a spring with a tightening mechanism secured within the shoe's heel for drawing a strap around the medial and lateral upper of the shoe.

However, none of the automated tightening systems heretofore devised has been entirely successful or satisfactory. Major shortcomings of the automated tightening systems of the prior art are that they fail to tighten the shoe from both sides so that it conforms snugly to the wearer's foot, and that they lack any provision for quickly loosening the shoe when it is desired to remove the shoe from the wearer's foot. Moreover, they frequently suffer from: (1) complexity, in that they involve numerous parts; (2) the inclusion of expensive parts, such as small electric motors; (3) the use of parts needing periodic replacement, e.g. a battery; and (4) the presence of parts requiring frequent maintenance. These aspects, as well as others not specifically mentioned, indicate that considerable improvement is needed in order to attain an automated tightening shoe that is completely successful and satisfactory.

SUMMARY OF THE INVENTION

The general purpose of the present invention is to provide an automated tightening shoe that is devoid of the various shortcomings and drawbacks characteristic of shoes of this sort which exist in the prior art.

Accordingly, the primary objective of the present invention is to produce an automated tightening shoe, especially a sport or athletic shoe, that tightens snugly about the wearer's foot from both sides and that can be loosened easily. It is a further objective of the present invention to provide an automated tightening system which requires no complex or expensive parts, and which includes no parts that need frequent maintenance or periodic replacement. Another objective of the present invention is to provide an automated tightening shoe which is easy to operate and trouble-free in use.

The foregoing general purpose and objectives of the present invention are fully achieved by the automated tightening shoe of the present invention. As stated previously, the principles of the invention are applicable to shoes of many types and styles, but are especially applicable to shoes of the sport or athletic variety. Accordingly, it is this sort of shoe which has been selected for illustrating the principles of the invention.

The automated tightening shoe of the invention includes a sole and an integral body member or shoe upper constructed of any common sport or athletic shoe material or materials connected to the sole. The integral body member or shoe upper includes a toe, a heel, a tongue, a gap above the tongue, and a reinforced lacing pad straddling the tongue, the reinforced lacing pad having a number of pairs of lace eyelets provided around the periphery of the gap. The shoe also includes a chamber in the sole adjacent to the heel and a passageway in the heel which communicates with the chamber in the sole and extends from the chamber upwardly through the upper. A pair of laces for tightening the shoe at the gap are provided. Each lace has one end anchored to a respective lace eyelet nearest to the toe of the shoe by an anchor button, extends through alternate ones of the lace eyelets in crisscross fashion over the tongue, and then passes through the material of the shoe upper to within the chamber in the sole whereat it is operatively associated with a tightening mechanism. The tightening mechanism can be one of several different forms.

Each of the tightening mechanism forms includes an engagement lace which resides partly within the chamber in the sole and partly within the passageway in the heel. The engagement lace is movable in a tightening direction along the chamber in the sole and along the passageway in the heel. In the first embodiment, the tightening mechanism includes, in addition to the engagement lace, two pairs of spring-loaded gripping cams housed within the chamber in the sole. The two pairs of spring-loaded gripping cams are located on opposite sides of the chamber in the sole and lie in a common plane parallel to the sole. Each of the laces passes between a respective pair of the spring-loaded gripping cams. After passing between the respective pairs of spring-loaded gripping cams, the laces are joined to each other and to one end of the engagement lace. The other end of the engagement lace extends out of the passageway in the heel and includes a pulling loop for grasping in order to move the engagement lace in the tightening direction. By pulling the loop, the laces are caused to tighten about the tongue and thereby tighten the shoe. The spring loaded gripping cams allow movement of the laces therebetween during tightening and prevent reverse movement of the laces after tightening is completed. Further provided is a recoil spring located within the chamber in the sole. The recoil spring has a first end connected to the engagement lace and a second end connected to a wall surface within the chamber in the sole. The recoil spring operates to draw the engagement lace back into the chamber in the sole after tightening is completed. A release lace connected to the spring-loaded gripping cams and to a release lever protruding outwardly from the passageway in the heel enables disengagement of the spring-loaded gripping cams from the laces to allow free reverse movement of the laces when it is desired to loosen the shoe to remove it from the wearer's foot.

A second embodiment of the tightening mechanism is identical in all respects to the first embodiment except for the positioning of the two pairs of spring-loaded gripping cams. In the second form, instead of the two pairs of spring-loaded gripping cams being located on opposite sides of the chamber in the sole in a common plane parallel to the sole, the two pairs of spring-loaded gripping cams are located one above the other in vertical alignment centrally of the chamber in the sole and are separated by a separation plate.

A third embodiment of the tightening mechanism involves, in addition to the engagement lace, a track extending vertically along the rear of the heel and a slide frictionally engaged in the track. The engagement lace is coupled to the slide within the passageway in the heel and is movable both upwardly and downwardly within the passageway in the heel by corresponding movement of the slide.

A fourth embodiment of the tightening mechanism involves, in addition to the engagement lace, an axle located within the chamber in the sole upon which a ratchet wheel with ratchet teeth is mounted. A pawl engageable with the ratchet teeth is affixed to the heel and is connected to a release lever which protrudes from the rear of the heel. The laces after entering the chamber in the sole are coiled in the same direction about opposite ends of the axle, and the engagement lace is coiled about the axle at a location approximately midway between the coiled laces but in a direction which is opposite to the direction in which the laces are coiled. The engagement lace has an end extending out of the passageway in the heel and includes a pulling loop for grasping to move it in the tightening direction. When the engagement lace is pulled by the pulling loop, the laces further coil about the axle and thereby the shoe is tightened. The pawl successively engages the ratchet teeth of the ratchet wheel to prevent reverse movement.

A fifth embodiment of the tightening mechanism of the present invention dispenses with the engagement lace and associated pulling loop or slide of the fourth embodiment, and instead uses an actuator wheel secured to the axle and extending slightly beyond the heel portion of the shoe sole. By rotating the actuator wheel, the axle rotates to wind the shoe laces connected to the axle in the ratchet wheel also secured to the axle to prevent counter-rotation of the axle. Operation of a release lever extending from the heel of the shoe upper disengages the pawl from the ratchet wheel teeth to enable counter-rotation of the axle so that the shoe laces may loosen to enable removal of the shoe from the foot.

Although all of the aspects and features of the automated tightening shoe enumerated above are important to the attainment of the purpose and objectives of the present invention and contribute to the overall superior quality, easy operation, and trouble-free performance of the shoe, certain ones are especially significant and merit special recognition.

One such significant aspect and feature of the present invention is the arrangement of crisscrossed laces which effects tightening of the automated tightening shoe from both sides, thus producing a snug fit about the wearer's foot.

Another such significant aspect and feature of the present invention is an engagement lace which is coupled to the laces and is movable in a tightening direction to tighten the laces.

Still another such significant aspect and feature of the present invention is a pair of spring-loaded gripping cams which allow movement of the laces during tightening and grip the laces to prevent reverse movement of the laces after tightening is completed.

Yet another such significant aspect and feature of the present invention is a release lace and release lever for disengaging the spring-loaded gripping cams from the laces to allow free reverse movement of the laces to enable loosening of the shoe for removal from the wearer's foot.

A still further such significant aspect and feature of the present invention is a recoil spring for drawing the engagement lace back in the reverse direction after tightening is completed.

Yet a further such significant aspect and feature of the present invention is a tightening mechanism which includes a track and slide.

Another significant aspect and feature of the present invention is a tightening mechanism which includes a ratchet wheel mounted on an axle, the ratchet wheel including ratchet teeth engageable by a pawl.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

For purposes of the present invention, "shoe" means any closed footwear having an upper part that helps to hold the shoe onto the foot, including but not limited to boots; work shoes; snow shoes; ski and snowboard boots; sport or athletic shoes like sneakers, tennis shoes, running shoes, golf shoes, cleats, and basketball shoes; ice skates, roller skates; in-line skates; skateboarding shoes; bowling shoes; hiking shoes or boots; dress shoes; walking shoes; dance shoes; and orthopedic shoes.

Although the present invention may be used in a variety of shoes, for illustrative purposes only, the invention is described herein with respect to athletic shoes. This is not meant to limit in any way the application of the automated tightening mechanism of this invention to other appropriate or desirable types of shoes.

Figure 1:
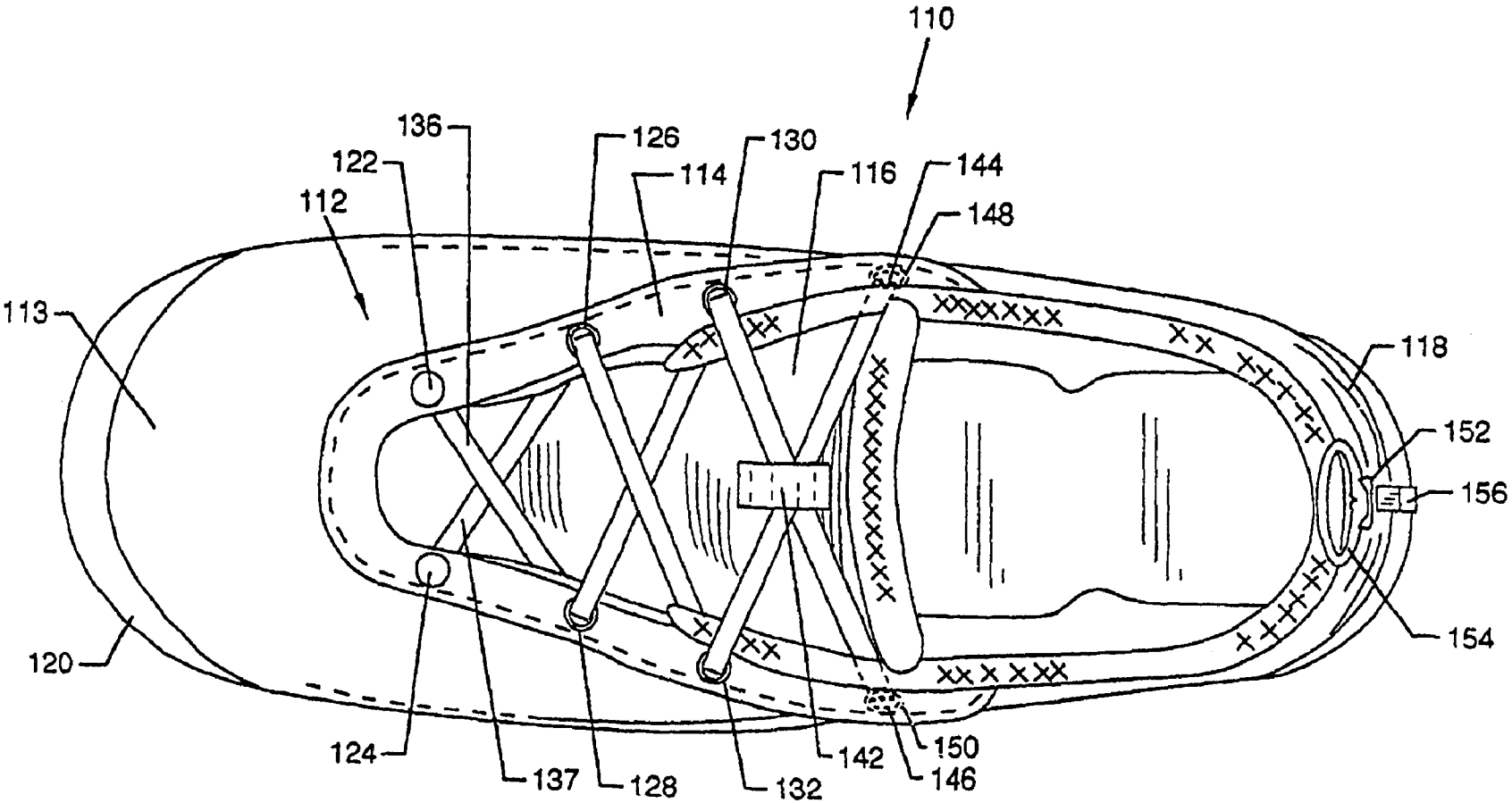
FIG. 1 illustrates a top view of an automated tightening shoe, the present invention, in the open condition.
Figure 2:
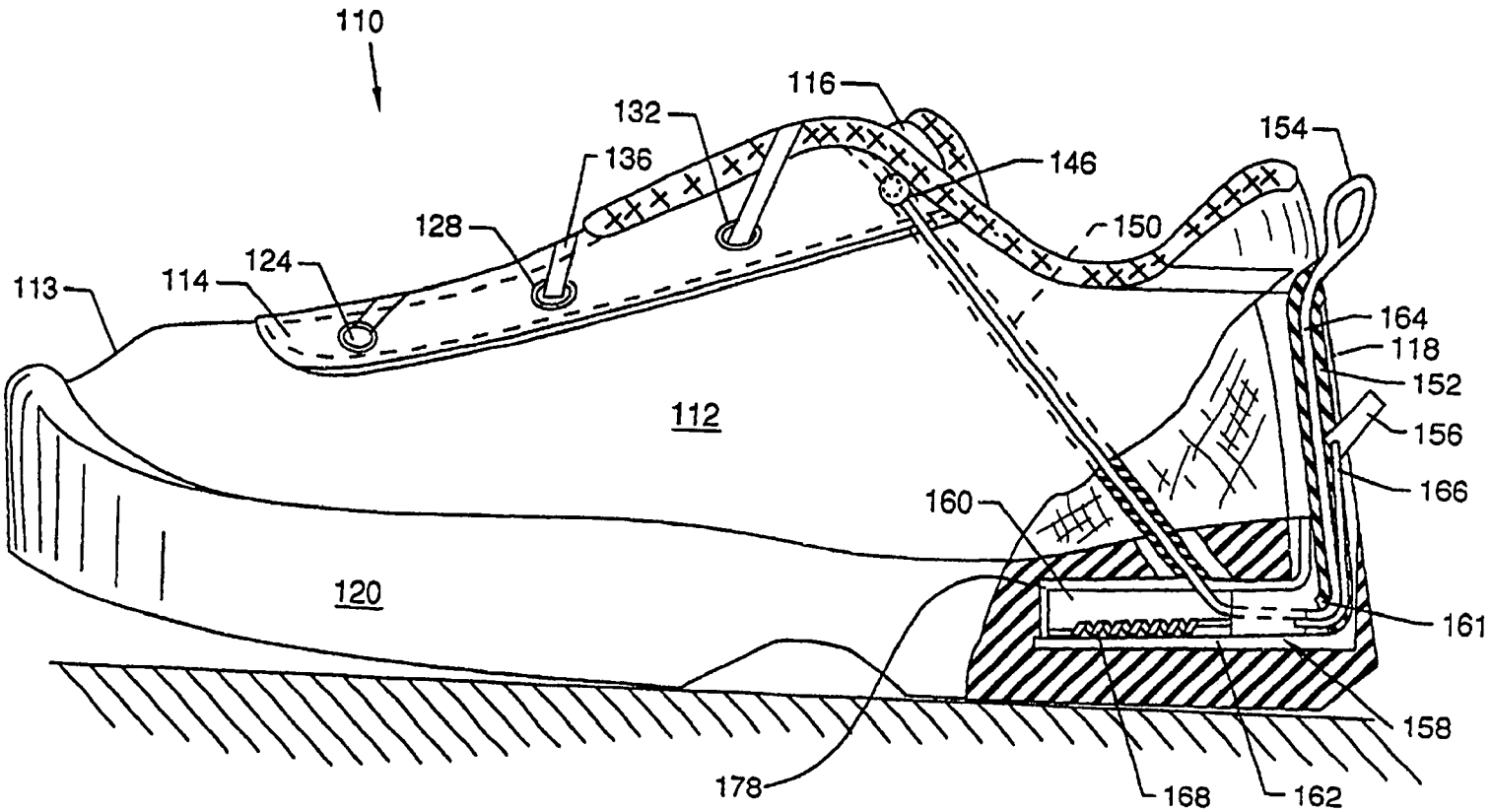
FIG. 2 illustrates a side view, in partial cutaway, of the automated tightening shoe with a first form of the tightening mechanism.

FIG. 1 illustrates a top view of an automated tightening shoe 110 of the present invention in the open condition, and FIG. 2 illustrates a side view, in partial cutaway, of the automated tightening shoe 110 with a first embodiment of the tightening mechanism. The automated tightening shoe 110 has a sole 120, an integral body member or shoe upper 112 including a tongue 116, a toe 113, a heel 118, and a reinforced lacing pad 114, all constructed of any appropriate material for the end use application of the shoe.

At the toe 113 end of tongue 116, there are provided two anchor buttons 122 and 124 which are secured to shoe laces 136 and 137, respectively, at one end. The shoe laces 136 and 137 then crisscross over tongue 116 and pass through lace eyelets 126, 128, 130, and 132, as illustrated, before passing through lace containment loop 142. After passing through lace containment loop 142, lace 136 passes through a hole 146 in the reinforced lacing pad 114 and travels downwardly and rearwardly through a section of tubing 150 which passes in-between the outer and inner materials of the shoe upper 112. Lace 137 passes through a hole 144 in the reinforced lacing pad 114 and travels downwardly and rearwardly through a section of tubing 148 which also passes in-between the outer and inner materials of the shoe upper 112, as illustrated.

The lower ends of tubing 148 and tubing 150 enter a chamber 160 located in the sole 120 of the automated tightening shoe 110 where shoe laces 136 and 137 leave tubings 148 and 150 and pass through a first embodiment of tightening mechanism 158 which is secured to a mechanism base 162 which in turn is secured to the interior of sole 120 inside chamber 160. There is also provided a housing plate 178 which covers the tightening mechanism 158 and which, in conjunction with mechanism base 162, encases the tightening mechanism 158.

As illustrated more fully in FIG. 1, after passing through the tightening mechanism 158, shoe laces 136 and 137 intersect and mutually secure to an engagement lace 164. Engagement lace 164 then passes through a section of tubing 152 which passes upwardly within a passageway 161 in the heel 118. The engagement lace 164 then passes out of tubing 152 and passageway 161 and terminates in a pulling loop 154. There is also provided a release lace 166 which is secured to the tightening mechanism 158 and passes upwardly through tubing 152 to about midway of tubing 152 where a release lever 156 enters tubing 152. Release lace 166 passes through release lever 156 and passes downwardly through tubing 152 and is secured to the tightening mechanism 158. The release lace 166 is taut at all times when the release lace 166 is properly secured. The release lever 156 acts as a toggle switch which disengages the tightening mechanism 158 when pressed downwardly. There is also provided a recoil spring 168 within chamber 160 which pulls the engagement lace 164 back into chamber 160 after engagement.

Figure 3:
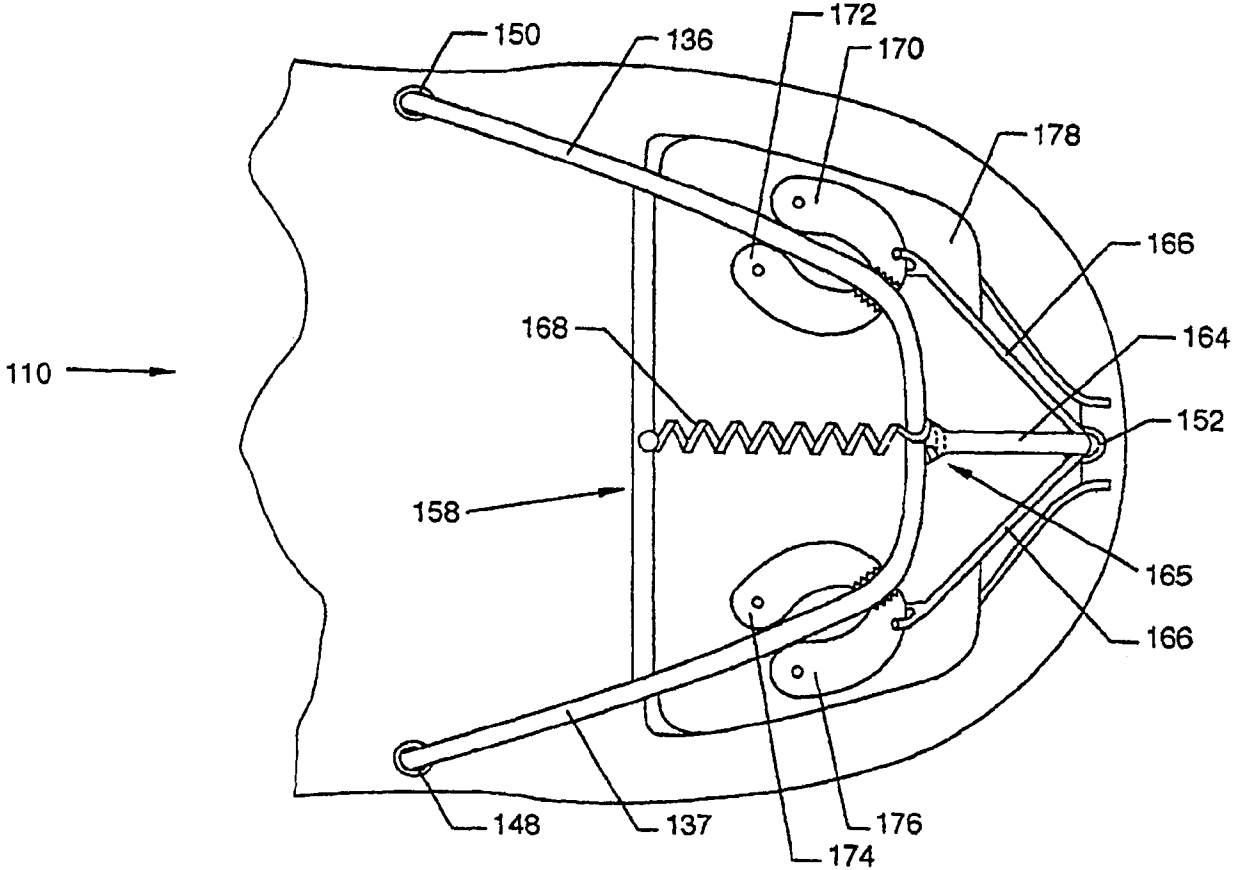
FIG. 3 illustrates a bottom view of the automated tightening shoe with the sole and mechanism base removed to reveal details of the first embodiment of the tightening mechanism.

The first embodiment of tightening mechanism 158 and its mode of operation will be more easily understood and further described with reference to FIG. 3. It constitutes a bottom view of the automated tightening shoe 110 with the sole 120 and mechanism base 162 removed for purposes of illustrative clarity to reveal details of the tightening mechanism 158, where all numerals which have appeared previously correspond to those elements previously described. Illustrated in particular is the tightening mechanism 158 and the orientation of its component parts. The tubings 148 and 150 guide the shoe laces 137 and 136, respectively, into the chamber 160 of sole 120. Then shoe lace 136 is guided between a pair of spring-loaded gripping cams 170 and 172, and shoe lace 137 is guided between a pair of spring-loaded gripping cams 174 and 176. Then both shoe laces 136 and 137 intersect and mutually connect to engagement lace 164 at an intersection point 165 located within chamber 160. Engagement lace 164 then passes upwardly through tubing 152 in passageway 161 to meet pulling loop 154. When pulling loop 154 is pulled upwardly until the shoe laces 136 and 137 tighten, the automated tightening shoe 110 snugly fits the wearer's foot. The spring-loaded gripping cams 170, 172, 174, and 176 then prevent the laces 135 and 137 from reverse travel. Meanwhile, the recoil spring 168 pulls back the slack of engagement lace 164 into chamber 160 to draw pulling loop 154 back against the external heel of the shoe. In order to remove the automated tightening shoe 110, release lever 156 is pushed downwardly, thereby causing release lace 166 to pull spring-loaded gripping cam 170 and 176 simultaneously away from laces 136 and 137 to create free movement in the laces. This free movement allows the user to easily remove the automated tightening shoe 110.

Figure 4:
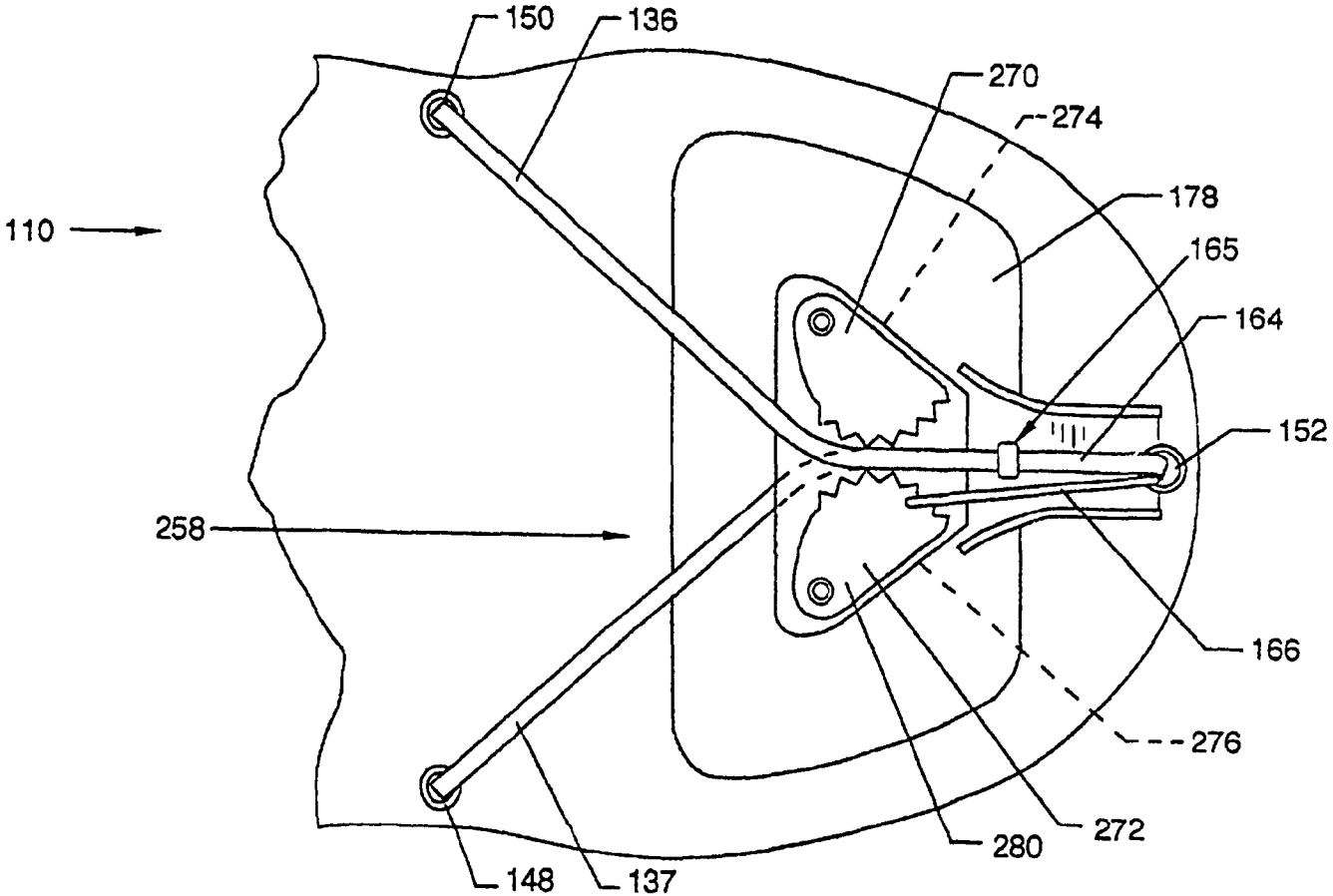
FIG. 4 illustrates a bottom view of the automated tightening shoe with the sole and mechanism base removed to reveal details of a second embodiment of the tightening mechanism.
Figure 5:
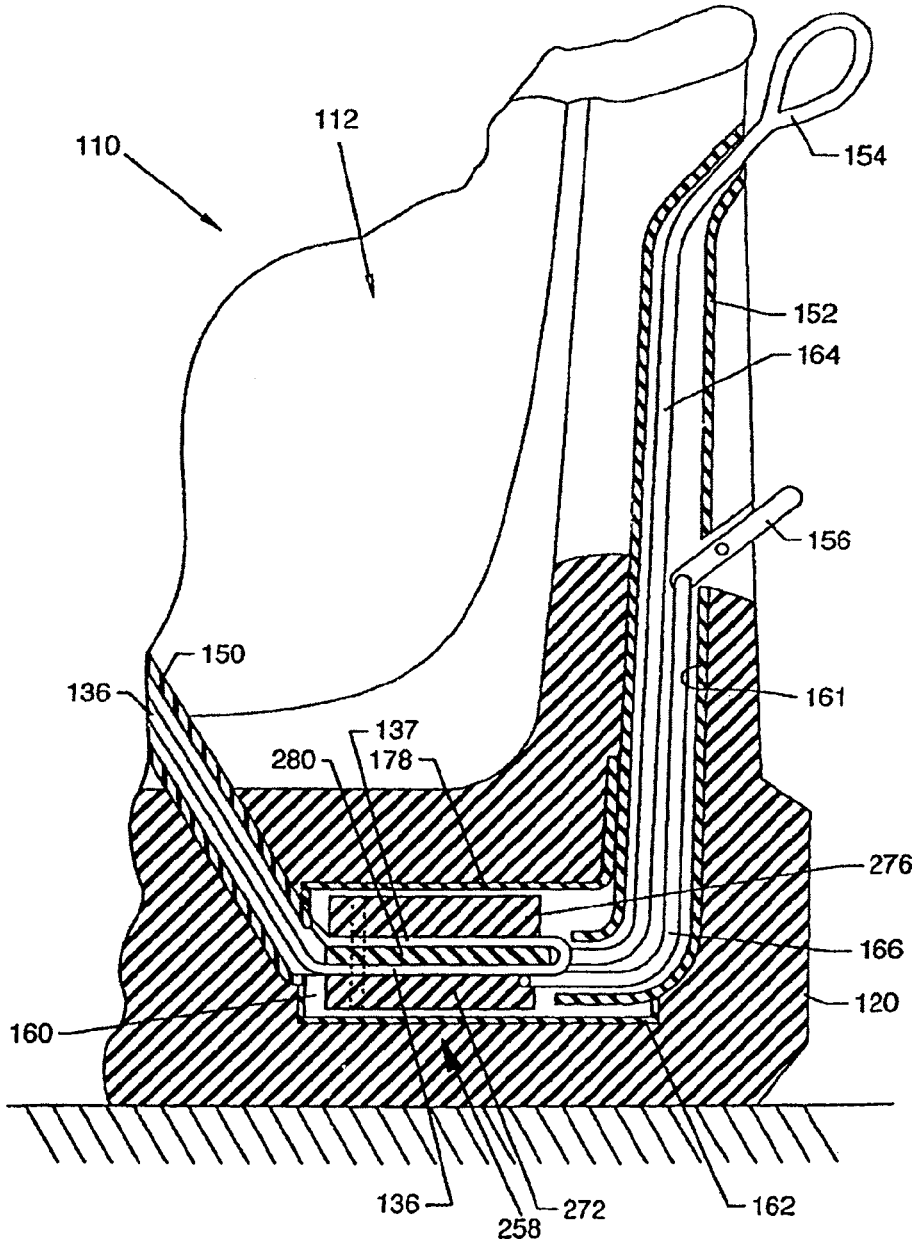
FIG. 5 illustrates a cross sectional view of the posterior portion of the automated tightening shoe provided with the second embodiment of the tightening mechanism.

FIG. 4 illustrates a bottom view of the automated tightening shoe 110 with the sole 120 and mechanism base 162 removed for purposes of illustrative clarity to reveal a second embodiment of tightening mechanism 258. FIG. 5 provides a cross sectional view of the posterior portion of the automated tightening shoe 110 provided with this second embodiment of tightening mechanism 258, where all numerals which have been mentioned before correspond to those elements previously described. These figures illustrate an alternative configuration of the components described in FIGS. 2 and 3. The second embodiment of tightening mechanism 258 functions and is constructed in a similar fashion to the first embodiment of tightening mechanism 158 having two pairs of spring-loaded gripping cams 270 and 272, and 274, and 276, vertically aligned and separated by a separation plate 280. Shoe lace 136 passes between spring-loaded gripping cams 270 and 272, and shoe lace 137 passes through spring-loaded gripping cams 274 and 276. Separation plate 280 prevents shoe laces 136 and 137 from entanglement, and allows the two pairs of spring-loaded gripping cams 270 and 272, and 274 and 276, to be vertically aligned to function without interfering with one another. After the shoe laces 136 and 137 pass through the pairs of spring-loaded gripping cams 270 and 272, and 274 and 276, they intersect and mutually connect to engagement lace 164. This second form of tightening mechanism functions in a similar fashion to the first form of tightening mechanism, only the configuration of the components is changed.

Figure 6:
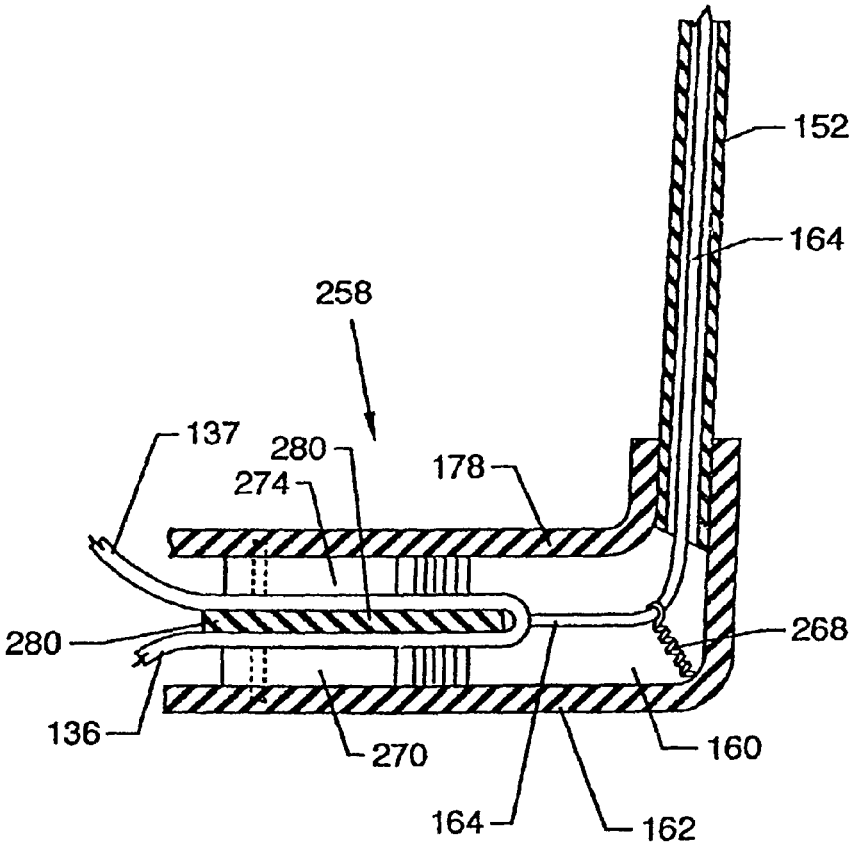
FIG. 6 illustrates a cross sectional view the second embodiment of the tightening mechanism.

FIG. 6 illustrates a cross sectional view of the tightening mechanism 258 of FIGS. 4 and 5, where all numerals which have appeared previously correspond to those elements previously described. Illustrated in particular is the recoil spring 268 which is secured at one end to mechanism base 162 and is secured over and about engagement lace 164 at the opposite end. Once the pulling loop 154 (See FIG. 5) is pulled to the desired tightness, this recoil spring 268 then pulls back the slack of engagement lace 164 into chamber 160, thereby causing pulling loop 154 to its original position. Also illustrated is the orientation of the mechanism base 162 in relation to the housing plate 178.

Figure 7:
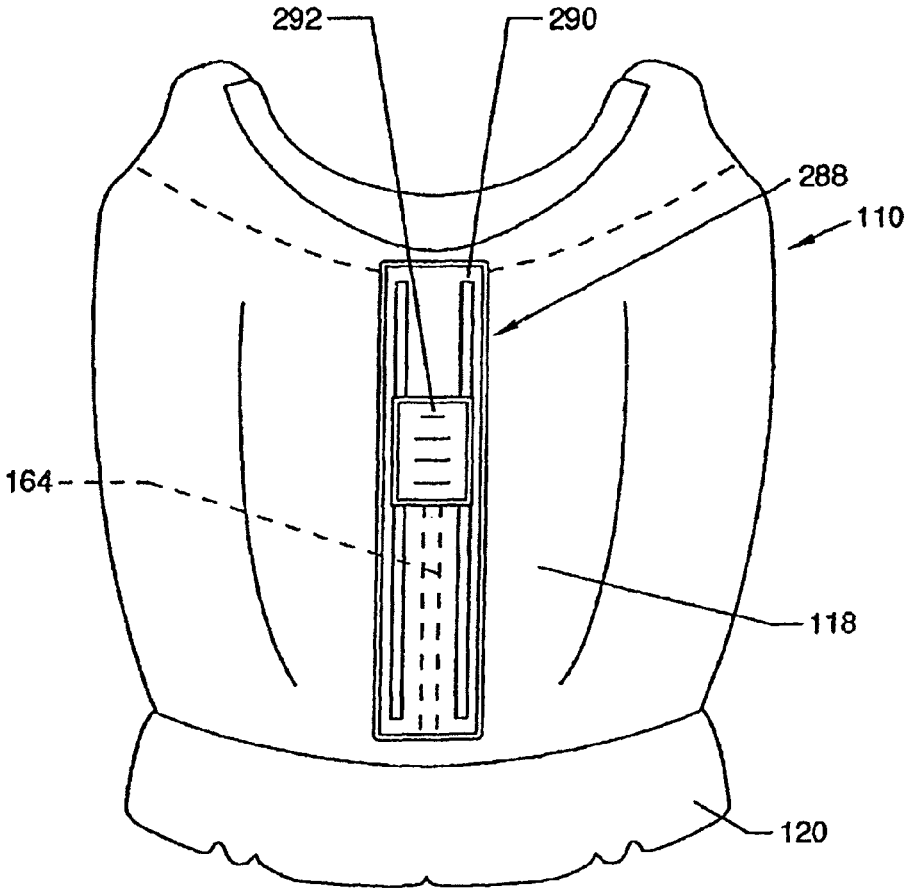
FIG. 7 illustrates a rear view of the automated tightening shoe incorporating a track and slide mechanism, a third embodiment of the tightening mechanism.

FIG. 7 depicts a rear view of the automated tightening shoe 110, incorporating a track and slide mechanism 288, which constitutes a third embodiment of the tightening mechanism of the present invention, where all numerals which have appeared previously correspond to those elements previously described. With additional reference to FIG. 5, the track and slide mechanism 288 can be substituted for the pulling loop 154 and release lever 156. The track and slide mechanism incorporates a track 290, which is frictionally engaged by a slide 292 that travels vertically along the length of track 290. By moving the slide 292 upwardly along track 290, the engagement lace 164 is actuated, thereby causing the automated tightening shoe 110 to tighten. Conversely, by moving the slide 292 downwardly along track 290, the engagement lace 164 is released, thereby enabling the automated tightening shoe 110 to be loosened.

Figure 8:
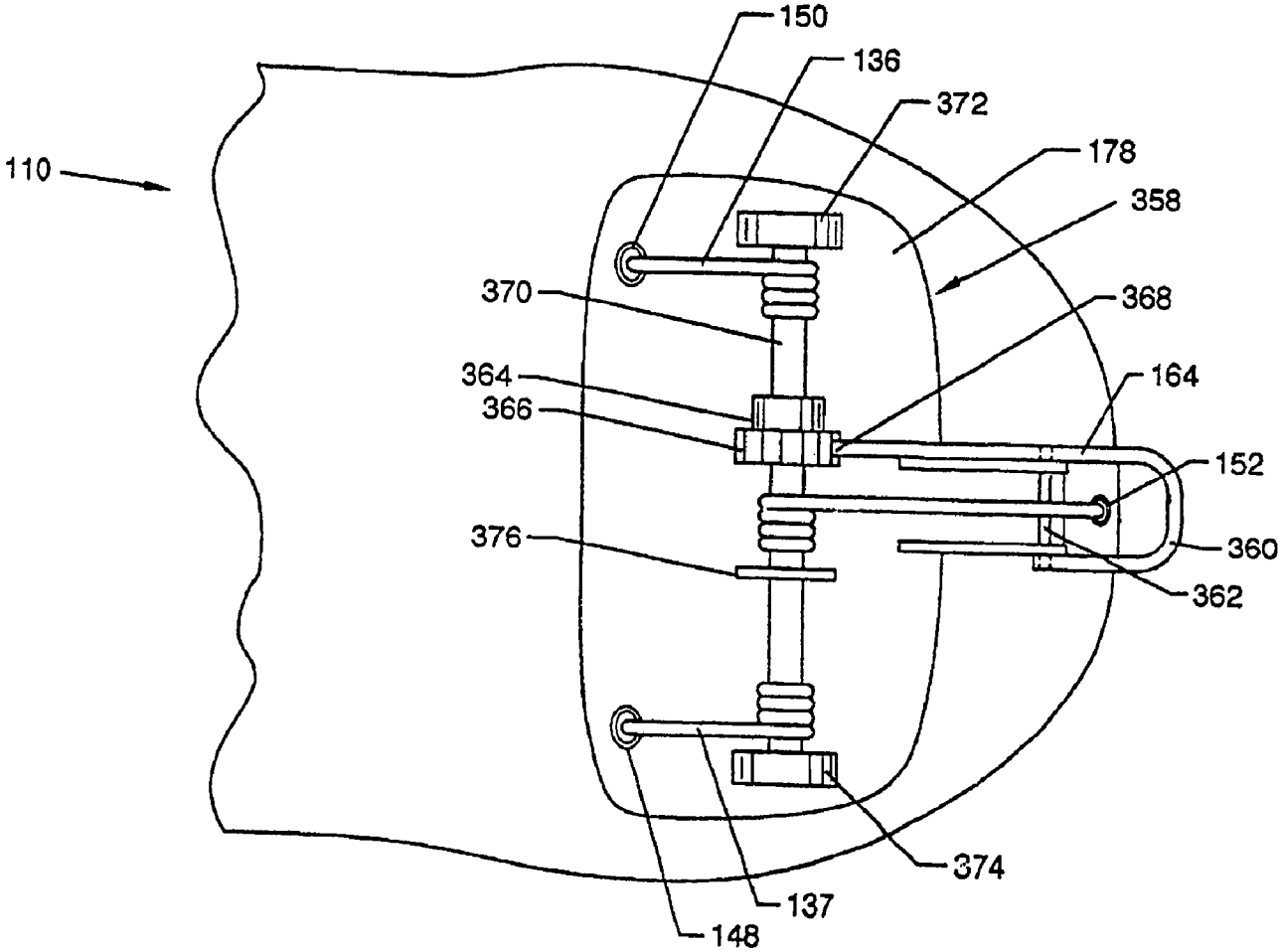
FIG. 8 illustrates a bottom view of the automated tightening shoe with the sole and mechanism base removed to reveal details of a fourth embodiment of the tightening mechanism.
Figure 9:
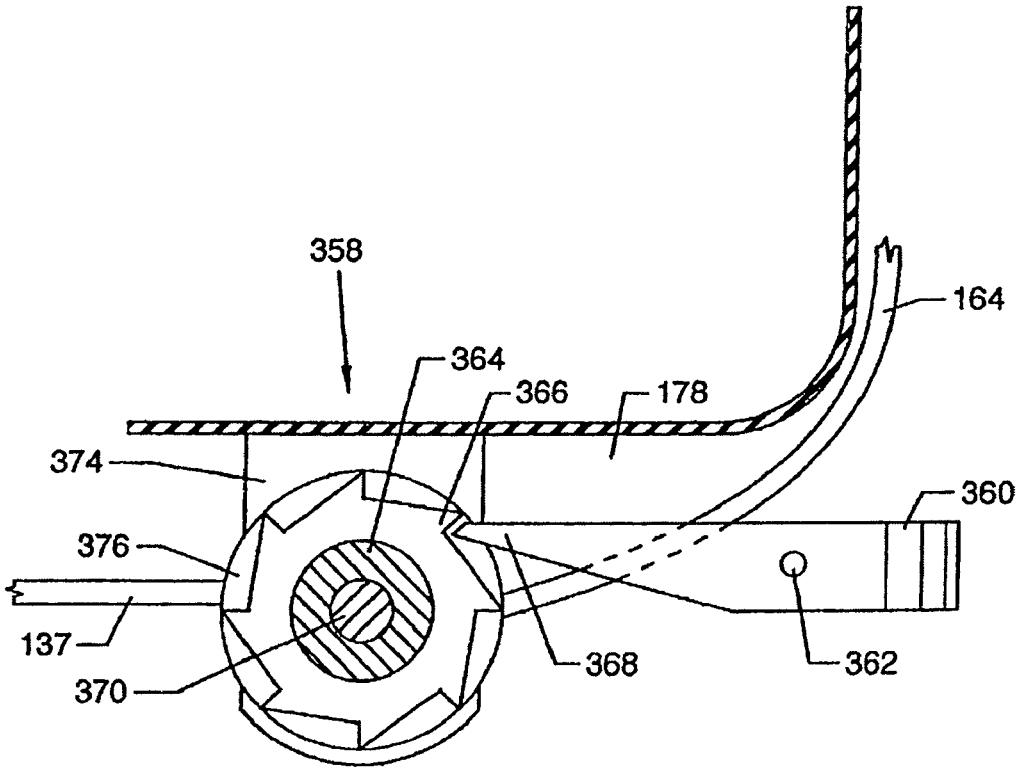
FIG. 9 illustrates a partial cross-sectional view of the fourth embodiment of the tightening mechanism.

FIG. 8 illustrates a bottom view of the automated tightening shoe 110 with the sole 120 and mechanism base 162 removed for purposes of illustrative clarity to reveal a fourth embodiment of tightening mechanism 358, and FIG. 9 illustrates a partial cross sectional view the tightening mechanism 358, where all numerals which have appeared previously correspond to those elements previously described. This tightening mechanism 358 can be substituted for the tightening mechanisms 158, 258 and 288 previously described for the invention without affecting the function or scope thereof. Tightening mechanism 358 is comprised of a housing plate 178 to which is secured a pair of axle support members 372 and 374, which extend downwardly in a perpendicular fashion and accommodate a ratchet wheel axle 370. A ratchet wheel 364 containing ratchet teeth 366 along its perimeter is secured along ratchet wheel axle 370 midway between axle support members 372 and 374. A release lever 360 is pivotally secured to housing plate 178 at its posterior end by a release lever axle 362. The inward end of release lever 360 incorporates a release lever pawl 368 which successively engages the teeth 366 of ratchet wheel 364, as illustrated. Shoe laces 136 and 137 are secured to ratchet wheel axle 370. As the axle rotates, the shoe laces wind about the axle. Engagement lace 164 is also secured to ratchet wheel axle 370 by means of pulling loop 154 or slide 292, but in the opposite direction. When the engagement lace 164 is pulled by means of pulling loop 154 or slide 292, the ratchet wheel axle 370 and the ratchet wheel 364 rotate in a counterclockwise fashion to further coil shoe laces 136 and 137, which tightens the automated tightening shoe 110 around the wearer's foot. This tension created at engagement causes the release lever pawl 368 to ratchetably engages ratchet teeth 366, thereby preventing slippage during engagement. In this manner, shoe 110 snugly fits the foot. Once release lever 360 is pushed down by the wearer's finger or other foot, however, release lever pawl 368 disengages ratchet tooth 366 to allow ratchet wheel axle 370 and the ratchet wheel 364 to travel in a clockwise fashion. Shoe laces 136 and continued 137 thereby uncoil from axle 370 to release the lace tension in the automated tightening shoe 110. Containment washer 376 is also provided to prevent shoe lace 137 from entangling with engagement lace 164. The ratchet wheel 364 acts as a containment device which prevents lace 136 from entangling with the engagement lace 164. The slack created in engagement lace 164 at engagement is pulled back into the shoe, as previously described, or a clutch mechanism like that used in lawnmower pull cords, can be incorporated to accomplish the same results.

It has been found that the horizontal axle ratchet and pawl embodiment 358 of the automated tightening mechanism of the present invention is relatively simple in construction and therefore dependable. It does not require the cooperative action of the multiple gripping cams of the first and second embodiments 158 and 258, respectively, nor does it run as much of a risk of shoe laces 136 and 137 becoming entangled. Thus, there is less of a chance of the automated tightening and loosening mechanism becoming fouled up or inoperative—an important consideration since none of the mechanisms 158, 258, or 358 are accessible to the wearer to enable fixing the mechanism.

One potential disadvantage, however, of automated tightening mechanism 358, however, is its reliance upon engagement lace 164 operated by pulling loop 154 or slide 292 to rotate ratchet axle 370 in a counterclockwise direction to tighten the shoe 110. Engagement lace 164 can become potentially entangled about axle 370 or with shoe laces 136 or 137, or with engagement lever 164, including pawl 368. Moreover, such engagement lace and pulling loop 154 or slide 292 constitute additional parts in the manufacturing process with the engagement lace 164 having to be threaded through the heel portion of the shoe upper and secured to ratchet wheel axle 370.

Figure 10:
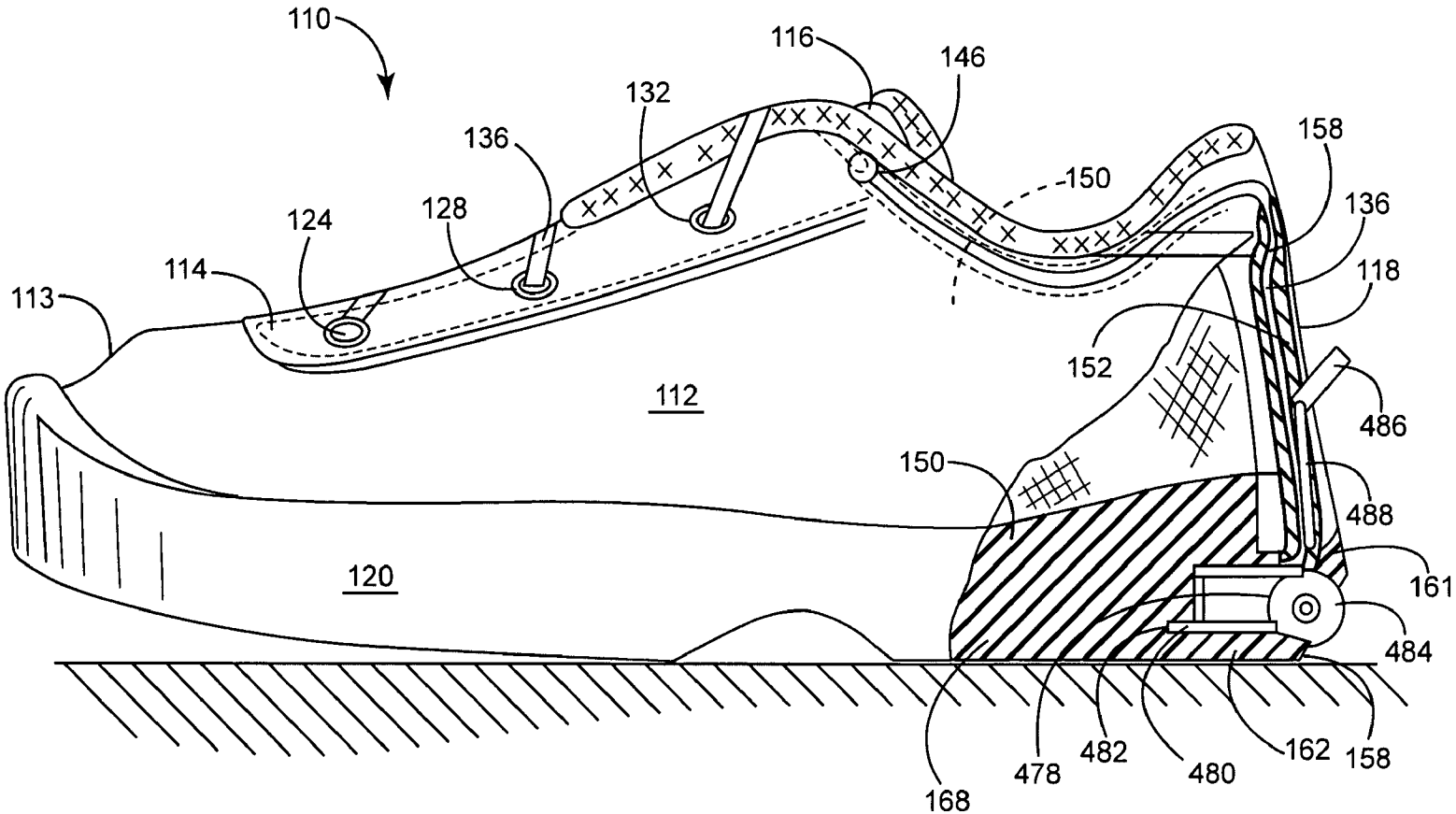
FIG. 10 illustrates a side view, in partial cutaway, of the automated tightening shoe with a fifth embodiment of the tightening mechanism.
Figure 11:
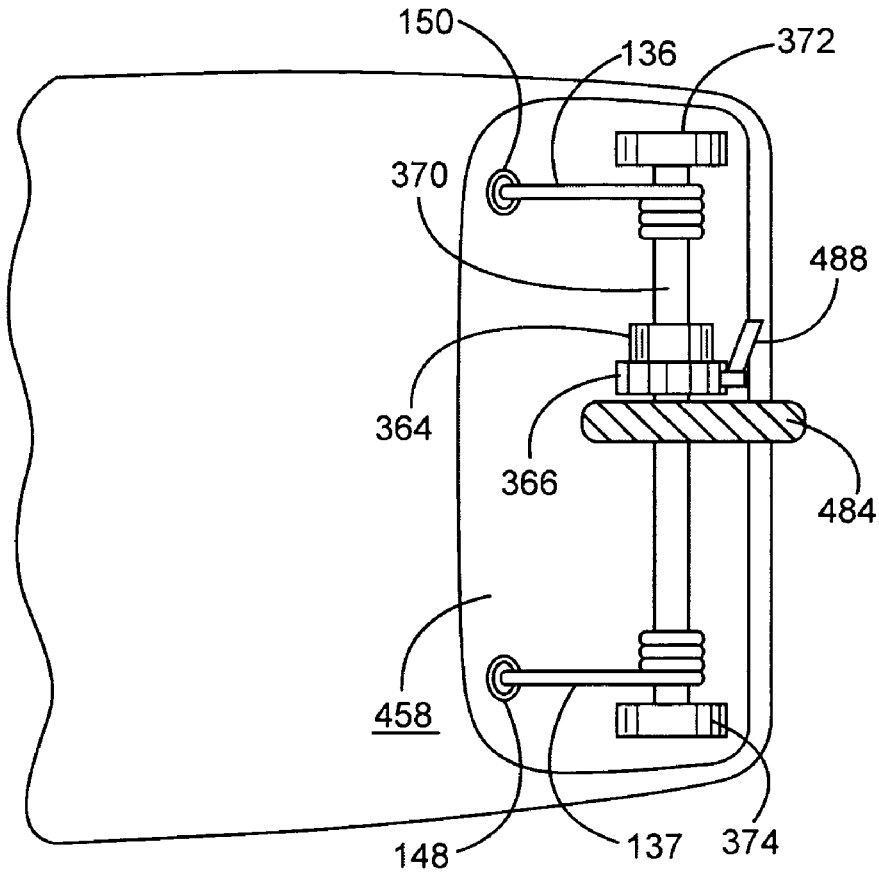
FIG. 11 illustrates a bottom view of the automated tightening shoe with the sole and mechanism base removed to reveal details of the fifth embodiment of the tightening mechanism.
Figure 12:
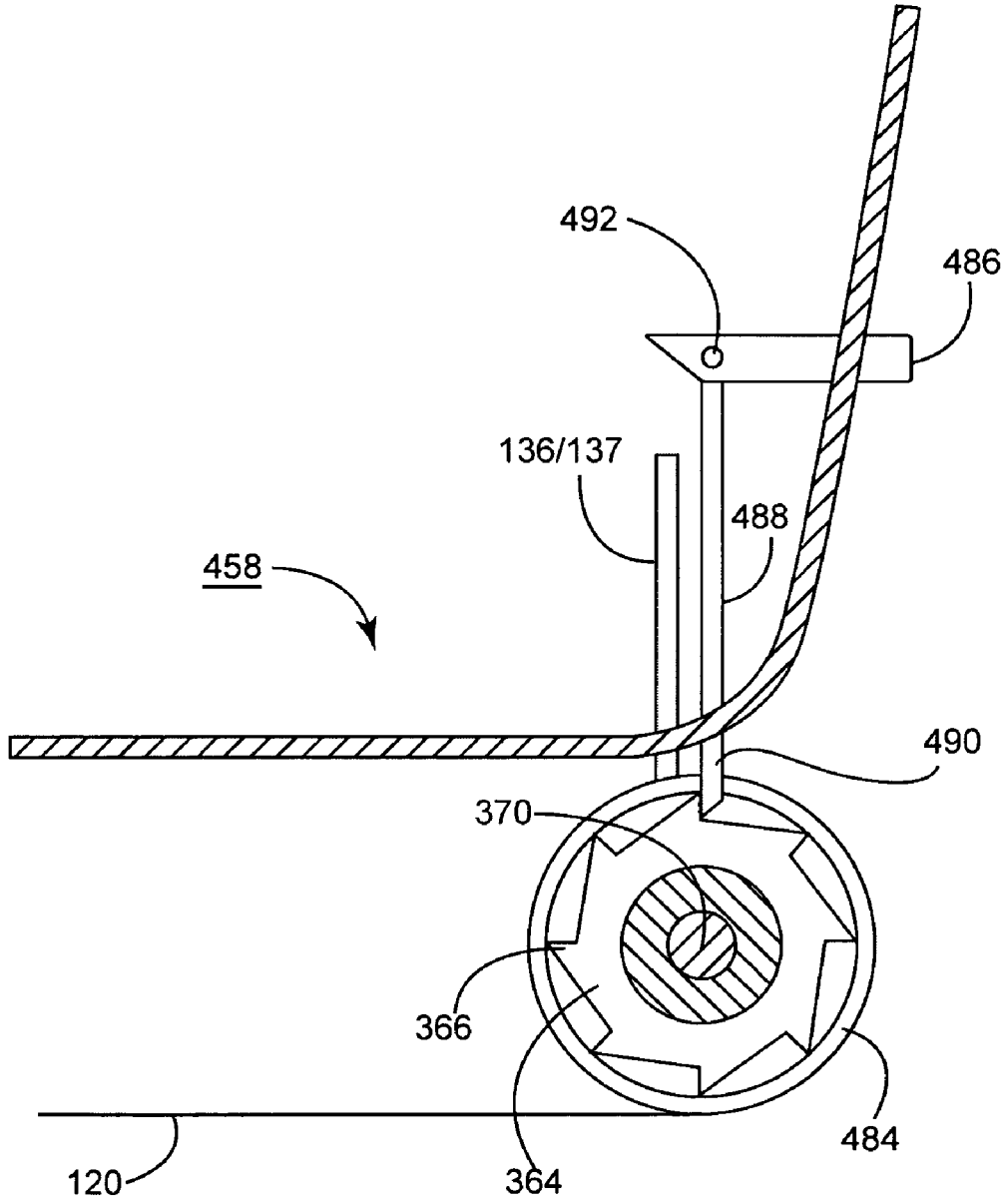
FIG. 12 illustrates a partial cross-sectional view of the fifth embodiment of the tightening mechanism.

A fifth embodiment 458 of the automated tightening mechanism of the present invention is therefore shown in FIGS. 10-12 in which the numbers are used for like elements appearing within the previously described embodiments. Automated tightening mechanism 478 is contained within housing 480 bearing housing plate 482. Actuator wheel 484 turns around ratchet wheel axle 370 and protrudes from housing 480 and the sole of shoe 110, as shown. Release lever 486, is connected to lever arm 488 terminating in pawl 490, whose structure and operation will be described below. Release lever 486 and lever arm 488 are located above tightening mechanism 478.

As can be seen more clearly in FIGS. 11 and 12, actuator wheel 484 is secured to ratchet wheel 364 having ratchet teeth 366. Shoe laces 136 and 137 are secured to opposite end regions of axle 370 and wind around the axle when it is rotated in the counterclockwise direction by actuator wheel 484.

Pawl 490 of release lever arm 488 prevents ratchet wheel 484 from rotating in the clockwise direction. Lever arm 488 is pivotably secured to release lever 486 at axis point 492. When release lever 486 is pushed down by the wearer's finger or other foot, it will lift lever arm 488 and pawl 490 away from engagement with teeth 366 of ratchet wheel 366. This permits axle 370 to rotate in the clockwise direction to enable shoe laces 136 and 137 to loosen.

In operation, the wearer will position his foot so that actuator wheel 484 extending from the heel of the shoe sole 120 abuts the floor or ground. By rolling the heel of the shoe away from his body, actuator wheel 484 will rotate in the counterclockwise direction. Axle 370 will likewise rotate in the counterclockwise direction, winding laces 136 and 137 around axle 370. In doing so, laces 136 and 137 will tighten within shoe 110 around the wearer's foot. Pawl 490 will ratchetably engages each tooth 366 of ratchet wheel 364 in progression to prevent clockwise rotation of the ratchet wheel that would otherwise loosen the shoe laces.

If the wearer wants to loosen the shoe laces 136 and 137 to take off shoe 110, he merely needs to push release lever 486 down. This causes pawl 490 to disengage ratchet wheel 364, as described above. As axle 370 rotates in the clockwise direction, the shoes laces will naturally loosen.

The automated tightening mechanism 458 of FIGS. 10-12 is simpler in design than embodiment 358 of FIGS. 8-9, dispensing with pulling loop 154 or slide 292, and engagement lace 164. Thus, there are fewer parts to assemble during shoe manufacture and to break down during usage of the shoe. Another substantial advantage of the automated tightening mechanism embodiment 458 of the present invention is that shoe laces 136, and 137 and their associated guide tubes may be threaded down the heel portion of the shoe upper, instead of diagonally through the medial and lateral uppers. This feature greatly simplifies manufacture of shoe 110. Moreover, by locating automated tightening mechanism 458 closer to the heel within shoe sole 120, a smaller housing chamber 478 may be used, and the unit may more easily be inserted and glued into a smaller recess within the shoe sole during manufacture.

Wheel actuator 484 may be any size diameter as long as it can extend from the shoe sole without interfering with the normal walking or running usage of the shoe. It preferably should be ½-inch in diameter. It may be made from any resilient and durable material like rubber, synthetic rubber, or a polymeric rubber-like material.

The above specification and drawings provide a complete description of the structure and operation of the automated tightening mechanism and shoe of the present invention. However, the invention is capable of use in various other combinations, modifications, embodiments, and environments without departing from the spirit and scope of the invention. Therefore, the description is not intended to limit the invention to the particular form disclosed.

I claim:

1. An automated tightening shoe, comprising:

(a) a shoe having a sole and an upper connected to the sole, the upper including a toe, a heel, a tongue having a fixed end adjacent to the toe, and a free end spaced rearwardly from the toe, and a lacing pad straddling the tongue, and having lace eyelets spaced along opposite sides thereof from adjacent to the fixed end of the tongue to adjacent to the free end of the tongue;

(b) a chamber in the sole closely adjacent to the heel, the chamber communicating with a passageway in the shoe which extends from the sole through the upper;

(c) a tightening mechanism contained within the chamber, the tightening mechanism including an axle with an actuator wheel rigidly connected to the axle and extending beyond the shoe sole at its rear heel end;

(d) a pair of laces, each lace being anchored at one end to a respective lace eyelet nearest the fixed end of the tongue, then extending through alternate ones of the lace eyelets in crisscross fashion over the tongue, then passing through the material of the upper through the passageway to within the chamber to be secured to the axle of the tightening mechanism;

(e) whereby rotation of the actuator wheel extending beyond the shoe sole causes rotation of the axle of the tightening mechanism to draw the shoe laces in a tightening direction, securement means operatively connected to the tightening mechanism for impeding counter-rotation of the axle to prevent the shoe laces from loosening; and (f) release means operatively connected to the securement means for selective disengagement of the securement means from the axle for enabling counter-rotation of the axle to allow the shoe laces to loosen.

2. The automated tightening shoe of claim 1, wherein the securement means comprises:

(a) at least one ratchet wheel having a plurality of teeth, such ratchet wheel attached to the axle of the tightening mechanism in a fixed relationship; and (b) pawl means connected to the release means, such pawl means engaging a tooth along the ratchet wheel to prevent counter-rotation of the axle of the tightening mechanism.

3. The automated tightening shoe of claim 1 further comprising a housing surrounding the tightening mechanism.

4. The automated tightening shoe of claim 1, wherein the release means comprises a pivotable lever.

5. The automated tightening shoe of claim 1, wherein the release means comprises a push button.

6. The automated tightening shoe of claim 1, wherein the release means comprises a pull loop.

7. The automated tightening shoe of claim 1 further comprising at least one guide tube located within the passageway of the shoe upper for containing one of the laces.

8. The automated tightening shoe of claim 1, wherein the passageway is located within the medial or lateral upper of the shoe.

9. The automated tightening shoe of claim 1, wherein the passageway is located within the heel portion of the upper of the shoe.

10. The automated tightening shoe of claim 1, wherein the actuator wheel is approximately one inch in diameter.

11. The automated tightening shoe of claim 1, wherein the actuator wheel is formed from natural rubber, synthetic rubber, or polymeric material.

12. The automated tightening shoe of claim 1, wherein the shoe comprises an athletic shoe.

13. The automated tightening shoe of claim 1, wherein the shoe comprises a hiking shoe.

14. The automated tightening shoe of claim 1, wherein the shoe comprises a boot.

15. The automated tightening shoe of claim 1, wherein the shoe comprises a recreational shoe.

* * * * *